United States Patent [19]

Woloszczuk

[11] Patent Number: 4,912,482

[45] Date of Patent: Mar. 27, 1990

[54] ANTENNA

[75] Inventor: Edmund W. Woloszczuk, Chelmsford, United Kingdom

[73] Assignee: The General Electric Company, p.l.c., London, United Kingdom

[21] Appl. No.: 75,969

[22] Filed: Jul. 21, 1987

[30] Foreign Application Priority Data

Jul. 24, 1986 [GB] United Kingdom ..... 8618086

[51] Int. Cl.[4] ..... H01Q 1/52

[52] U.S. Cl. ..... 343/841; 343/789; 343/893

[58] Field of Search ..... 343/841, 700, 770, 824, 343/789, 893, 725, 727, 729

[56] References Cited

U.S. PATENT DOCUMENTS

| | | | |
|---|---|---|---|
| 2,455,403 | 12/1948 | Brown . | |
| 3,622,884 | 11/1971 | Kent . | |
| 3,701,158 | 10/1972 | Johnson | 343/770 |
| 3,832,716 | 8/1974 | Plunk et al. | 343/770 |
| 4,141,012 | 2/1979 | Hockham et al. | 343/893 |
| 4,287,518 | 9/1981 | Frosch . | |
| 4,668,956 | 5/1987 | Mahnad | 343/789 |
| 4,679,051 | 7/1987 | Yabu et al. | 343/700 MS |

FOREIGN PATENT DOCUMENTS

| | | | |
|---|---|---|---|
| 2160320 | 6/1972 | Fed. Rep. of Germany . | |
| 2802585 | 8/1978 | Fed. Rep. of Germany | 343/727 |
| 1200570 | 12/1959 | France | 343/770 |
| 0064313 | 11/1982 | France . | |
| 0052550 | 4/1977 | Japan | 343/770 |
| 1234751 | 6/1971 | United Kingdom . | |
| 1535954 | 12/1978 | United Kingdom . | |
| 2079063 | 1/1982 | United Kingdom . | |
| 2140974 | 12/1984 | United Kingdom . | |

*Primary Examiner*—Rolf Hille
*Assistant Examiner*—Hoanganh Le
*Attorney, Agent, or Firm*—Spencer & Frank

[57] ABSTRACT

An antenna includes an array of electrically conductive cells each having one open side and containing a radiating/receiving element. The conductive cells reduce mutual coupling between elements.

14 Claims, 2 Drawing Sheets

ANTENNA

FIELD OF THE INVENTION

This invention relates to an antenna comprising an array of elements.

DESCRIPTION OF THE PRIOR ART

A common problem in such antennas is mutual coupling between the elements. This is discussed, for example, in "Introduction to radar systems" by Merrill I. Skolnik, second edition, published 1980 by McGraw-Hill Inc, on page 262. Also discussed is a known way of dealing with the problem by compensating for it by adjusting the distribution of phase over the antenna aperture. The adjustments made are decided upon by a combined process of trial and error and reasoned guesswork and are therefore not entirely effective.

BRIEF SUMMARY OF THE INVENTION

This invention aims to deal with the problem by reducing the level of mutual coupling rather than by compensating for mutual coupling.

This invention provides an antenna comprising an array of electrically conductive cells each having one open side and containing a radiating or receiving element in which adjacent cells share a common wall.

It has been found that, by employing this technique, it is possible significantly to reduce the level of mutual coupling between the elements.

Because adjacent cells share a common wall the cells can be formed in a "honeycomb" type structure. Such a structure can be simply and inexpensively made yet have a high degree of rigidity. In such a honeycomb structure the cells have to be a shape that can be tesselated, such as an equilateral triangle or hexagon. The preferred form is however a rectangular parallelopiped.

In a preferred form of antenna each radiating or receiving element is a monopole. Monopoles are preferred because they can be very simple to manufacture. If monopoles are used it is preferred that each be in the form of a plate which is parallel to an open face of its associated cell. Using such a structure it is possible to achieve high gain and, if required, an assymetric beam such as might be required to minimise the signal directed to or received from the ground. However the invention is equally applicable to systems where the radiating or receiving elements are of some other type, such as dipoles or slots.

Particularly if monopoles are used it is convenient to feed them by means of a triplate structure located between rows or columns of the cells such that each outer plate of the triplate forms a wall of a cell. Other types of feed such as co-axial lines or slotted waveguides could be used. If some other type of radiating or receiving element were used a different feed may be preferred. For a dipole it may be preferred to use a co-axial feed; or a triplate feed where one outer plate of the triplate forms a rear wall for the cells. For a slotted waveguide feed, the waveguides could be positioned along the back of the array and have a slotted opening into the back of each cell.

A triplate in this description is defined as two, generally parallel, conductive layers or sheets having one or more inner conductors located in a plane between them. In use the outer conductors are normally earthed and the signal to be transmitted is applied to the inner conductor or conductors. It is possible for two or more triplates to be defined within a single structure in which adjacent triplates share a common "outer" conductor.

One way of performing the invention will now be described with reference to the accompanying drawings in which;

DETAILED DESCRIPTION

Figure 1:
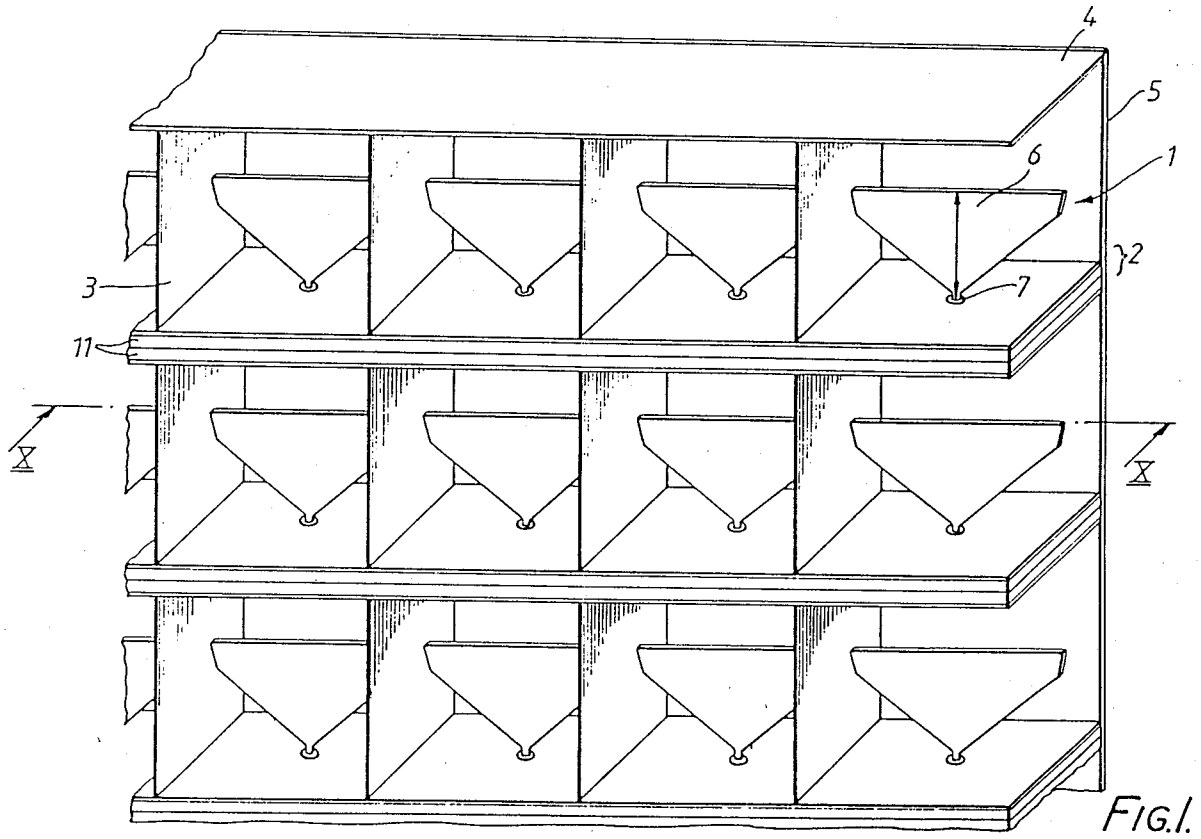
FIG. 1 is a perspective view, shown broken away, of part of an antenna constructed in accordance with the invention.

Referring to FIG. 1 a honeycomb array of cells 1 are formed by horizontal triplates 2 and vertical conductive plates 3, the vertical conductive plates 3 being soldered to the outer conductors of the triplates 2. The top of the array is formed by a horizontal conductive sheet 4 because a triplate feed is not required there. The front of each cell is open and the back of each cell is closed by a conductive back plate 5. The end wall of the array has been removed in the illustration in order to clearly show the internal structure.

Each cell 1 contains a monopole 6 which extends vertically in the direction of the double headed arrow from a feed point 7 at the bottom of the cell through a distance of $0.35\lambda$, where $\lambda$ is the wavelength at the frequency to be transmitted or received. Other sizes of monopole are, of course, possible but the best results have been obtained using monopole lengths in the $0.25\lambda$ to $0.35\lambda$ range. The height of the cell is twice the length of the monopole and the width and height of the cell are the same.

Each monopole is approximately triangular so that its top edge extends horizontally between plates 3. This is advantageous because it has been found that, in general, the larger the area of the monopole the larger the bandwidth of the radiating or receiving element.

The back plate 5 forms a reflector analogous to the reflector commonly used behind most antenna arrays to produce a radiation pattern that is unidirectional. The array would work without the back plate 5 but a bidirectional radiation pattern of the antenna is usually unsuitable. The distance between the monopole and the back plate 5 is usually $0.25\lambda$. The distance between the monopole and the front of the cell is not critical but the larger this distance is the smaller the mutual coupling between the elements in the array will be.

Figure 2:
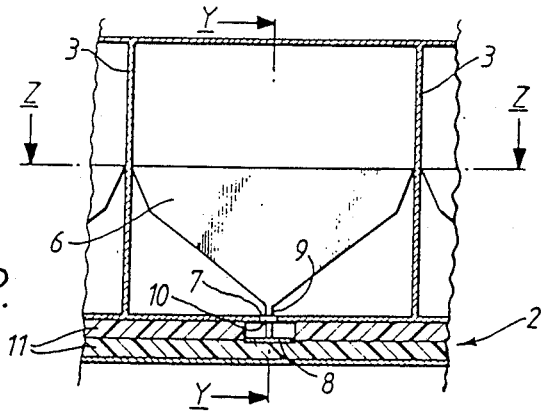
FIG. 2 is a vertical cross-section through the line X—X of FIG. 1 showing one cell of the antenna.
Figure 3:
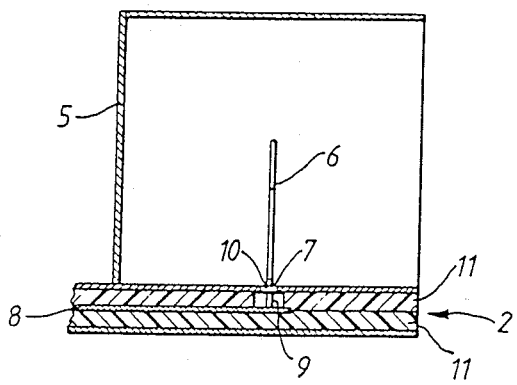
FIG. 3 is a vertical cross-section through the line Y—Y of FIG. 2.
Figure 4:
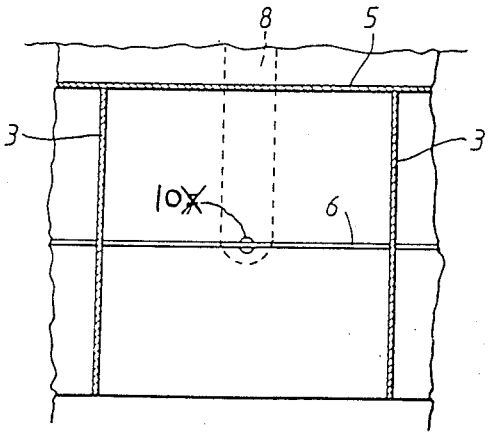
FIG. 4 is a vertical cross-section along the line Z—Z in FIG. 2.

FIGS. 2, 3 and 4 show how a monopole 6 is fed with a signal from the triplate 2. The triplate 2 has a central conductor 8 forming part of a feed system and terminating at a point immediately below the feed point 7 of the monopole 6 and linked thereto by a coupling 9 which is separated from the earthed plate of the triplate by an insulator 10. The central conductor 8 is separated from the earthed plates of the triplate by two layers of dielectric material 11.

I claim:

1. An antenna system comprising: a plurality of antenna structures; and an array of electrically conductive cells having walls, each cell having one open side and containing a respective one of the antenna structures, in which adjacent cells share a common wall and in which the common walls between first and second adjacent portions of the array are defined by a three conductor transmission line which forms a feed system for the antenna structures contained in the cells of at least one of the first and second portions of the array.

2. An antenna system as claimed in claim 1 in which the first and second portions of the array are two adjacent rows of cells, the three conductor transmission line forming a feed system for the cells of at least one of those rows.

3. An antenna system as claimed in claim 2 in which each cell is a rectangular parallelepiped.

4. An antenna system as claimed in claim 3 in which each antenna structure is a monopole.

5. An antenna system as claimed in claim 2 in which each antenna structure is a monopole.

6. An antenna system as claimed in claim 2 in which each antenna structure is a monopole.

7. An antenna system as claimed in claim 1 in which each cell is a rectangular parallelepiped.

8. An antenna system as claimed in claim 7 in which each antenna structure is a monopole.

9. An antenna system as claimed in claim 1 in which each antenna structure is a monopole.

10. An antenna system as claimed in claim 1 in which the first and second portions of the array are two adjacent columns of cells, the three conductor transmission line forming a feed system for the cells of at least one of those columns.

11. An antenna system, comprising:

a conductive first wall;

a second wall which is spaced apart from the first wall and which is substantially parallel to the first wall, the second wall being a three layer transmission line having internal conductors in a middle layer;

a conductive back wall connecting the first and second walls, the back wall being disposed substantially perpendicular to the first and second walls;

a plurality of conductive intermediate walls extending from the first wall to the second wall, the intermediate walls being substantially perpendicular to the first and second walls and to the back wall, the intermediate walls being spaced apart from one another to provide a plurality of conductive cells, each cell having one side open; and a plurality of antenna structures, each antenna structure being disposed in a respective cell and being connected to a respective internal conductor of the second wall.

12. The antenna system of claim 11, wherein each antenna structure is a flat monopole which is substantially parallel to the back wall and which is supported by the second wall.

13. The antenna system of claim 11, further comprising:

a third wall which is spaced apart from the second wall and which is substantially parallel to the second wall, the third wall being a three layer transmission line having internal conductors in a middle layer, the back wall additionally being connected to the third wall;

a plurality of conductive additional intermediate walls extending from the second wall to the third wall, the additional intermediate walls being substantially perpendicular to the second and third walls and to the back walls, the additional intermediate walls being spaced apart from one another to provide a plurality of additional conductive cells, each additional cell having one side open; and a plurality of additional antenna structures, each additional antenna structure being disposed in a respective additional cell and being connected to a respective internal conductor of the third wall.

14. The antenna system of claim 13, wherein each antenna structure and additional antenna structure is a flat monopole which is substantially parallel to the back wall and is which is supported by one of the second and third walls.

* * * * *